US005355766A

United States Patent [19]

Brede et al.

[11] Patent Number: 5,355,766

[45] Date of Patent: Oct. 18, 1994

[54] DEVICE FOR IGNITING A PROPELLANT CHARGE, A CARTRIDGE FOR THE CHARGE AND A MAGAZINE FOR HOLDING CARTRIDGES, ESPECIALLY FOR STUD SETTING OR DRIVING TOOLS

[75] Inventors: Uwe Brede, Fürth; Alfred Hörr, Zirndorf; Hans Jena, Fürth; Bodo Preis, Nurnberg; Wolfgang Spranger, Fürth, all of Fed. Rep. of Germany

[73] Assignee: Dynamit Nobel Aktiengesellschaft, Troisdorf, Fed. Rep. of Germany

[21] Appl. No.: 67,985

[22] Filed: May 27, 1993

Related U.S. Application Data

[62] Division of Ser. No. 803,990, Dec. 9, 1991, Pat. No. 5,216,200.

[30] Foreign Application Priority Data

Dec. 7, 1990 [DE] Fed. Rep. of Germany ..... 4039069

[51] Int. Cl.[5] ..... F42B 39/08

[52] U.S. Cl. ..... 89/35.01; 102/281

[58] Field of Search ..... 42/57; 89/35.01; 102/281, 531, 702; 227/9, 10, 11

[56] References Cited

U.S. PATENT DOCUMENTS

| | | | |
|---|---|---|---|
| 4,056,062 | 11/1977 | Walser et al. | 89/35.01 |
| 4,098,169 | 7/1978 | Gawlick et al. | 89/35.01 |
| 4,819,562 | 4/1989 | Bowman | 102/281 |

FOREIGN PATENT DOCUMENTS

| | | | |
|---|---|---|---|
| 2446682 | 4/1976 | Fed. Rep. of Germany | 89/35.01 |
| 89041 | 4/1967 | France | 89/35.01 |

*Primary Examiner*—Stephen C. Bentley

*Attorney, Agent, or Firm*—Antonelli, Terry, Stout & Kraus

[57] ABSTRACT

A magazine for cartridges ignitable by adiabatic compression is especially useful for stud driving or setting tools. The magazine has a plurality of cartridges made of synthetic resin and a magazine belt made of synthetic resin for connecting the plurality of cartridges together. The magazine belt forms bottom walls of the cartridges and in the region of each of the bottom walls is provided with an intentional separation zone. A primer wafer is provided on the magazine belt in the region of the bottom wall near the intentional separation zone. Each primer wafer in an area near the intentional separation zone is thinner than in the remaining zone surrounding the area.

16 Claims, 3 Drawing Sheets

DEVICE FOR IGNITING A PROPELLANT CHARGE, A CARTRIDGE FOR THE CHARGE AND A MAGAZINE FOR HOLDING CARTRIDGES, ESPECIALLY FOR STUD SETTING OR DRIVING TOOLS

This application is a division application of U.S. application Ser. No. 803,990, filed Dec. 9, 1991, now U.S. Pat. No. 5,216,200.

BACKGROUND OF THE INVENTION

This invention relates to a device for the ignition of a propellant charge, especially for stud driving or setting tools, with a housing wherein a cavity is formed, a piston displaceably guided in the cavity for compressing a gas (air) present in the cavity, and a chamber connected to the cavity by way of an opening, a propellant charge being arranged in this chamber and ignitable by compression of gas upon displacement of the piston.

The ignition of propellant charges can be effected electrically or by mechanical or thermal action. In case of mechanical effect, a firing pin strikes against a case member containing the propellant charge; the primer charge disposed ahead of the propellant charge is heated and ignited in the case member by mutual friction of the particles. One disadvantage of igniting a propellant charge by means of a firing pin resides in the erosive stress and contamination of the barrel by the friction agents contained in the primer charge. Here, adiabatic ignition offers advantages wherein the propellant charge is ignited by a primer charge which, in turn, is initiated by heat produced as a consequence of adiabatic compression of air or gas.

An apparatus for the adiabatic ignition of a propellant charge has been known from DOS 2,103,253. The conventional device comprises a housing wherein a (cylindrical) cavity is formed. A spring-loaded piston is arranged in the cavity for compressing the gas present in the cavity. A barrel for adjoins the cavity in an axial extension of the latter; in the end section of this barrel (cartridge chamber) facing the cavity, a caseless projectile is disposed with a chamber for receiving the propellant charge that is open toward the cavity. The cross-sectional area of the cartridge chamber is relatively large as compared with the cross-sectional are of the cavity. Consequently, the force acting during combustion of the propellant charge on the piston, which piston is in its bottom dead center position, is relatively large. Due to this force, the piston is moved back against the spring so that the gas generation during ignition of the propellant charge is converted only inadequately into a forward motion of the projectile.

U.S. Pat. No. 4,856,433 discloses an initiator for activating an aircraft crew rescue system. A gas-producing charge is ignited in an initiating device. The rescue system is activated by the rising pressure. The gas-generating charge is ignited by adiabatic compression. Also, in this conventional device, the duct leading from the compression chamber to the propellant charge exhibits a relatively large cross-sectional area.

SUMMARY OF THE INVENTION

The invention is based on the object of providing a device for igniting a propellant charge of a tool for driving a nail or like projectile, especially for stud driving or setting tools, wherein escape of the gas pressure upon ignition of the propellant charge back into a superjacent cavity is most extensively precluded.

In order to attain this object, the invention proposes that an opening connecting the cavity and the chamber is fashioned as a nozzle or passage with a cross-sectional area smaller by a multiple than the cavity, the piston, or the chamber; and that the nozzle is covered by a primer wafer for the propellant charge, arranged in the chamber, the thickness of the primer wafer in the region of the nozzle and around the nozzle being smaller than in the remaining zone of the primer wafer.

According to the invention, a nozzle or passage having an extremely small cross-sectional area as compared with the cross-sectional area of the cavity and/or of the chamber is arranged between the cavity and the chamber for the propellant charge. On account of this extremely small cross-sectional area, the chamber can be considered to be practically closed along its wall equipped with the nozzle; therefore, the gas, during combustion of the propellant charge, can escape back into the cavity to an only rather minor extent. Owing to its small cross-sectional area, the nozzle acts as a throttle practically preventing a backflow of (combustion) gases into the cavity. The nozzle cross section is, in any event, substantially smaller than that of the at least one exhaust port by way of which the combustion gases are to exit upon ignition of the propellant charge; for example, for advancing a thrust piston in a stud driving or setting tool.

Based on the small nozzle cross section, however, the introduction of energy into the chamber during the adiabatic compression of the gas of the cavity is relatively poor. With respect to this feature, a relatively large nozzle aperture would be desirable which, as described heretofore, has, in turn, a negative effect on the conversion of the propellant charge. In the device according to this invention, the nozzle aperture or opening is covered by a primer wafer arranged in the chamber, the thickness of this primer wafer in the zone of the nozzle aperture being smaller than in the remaining zone. The primer wafer preferably consists of a sensitized primer material, especially sensitized nitrocellulose. The primer wafer is thinner precisely in its region under mechanical thermal stress, namely in the zone of the nozzle aperture and around the aperture, thus responding earlier in the mechanically thermally stressed region. In this region of lesser thickness, fragmenting of the primer wafer takes place under the effect of pressure caused by the (hot) compressed gas. The breaking apart of the primer wafer is accompanied by an enlargement of the surface area of the primer material so that, for ignition, lower gas temperatures and lower compressive stresses are already sufficient. However, reduction of the thickness of the primer wafer, which latter preferably involves a (powder) press-molded component, would not be sufficient by itself for a safe ignition of the propellant charge. Rather, it is necessary for this purpose to provide an adequate amount of sensitized primer material. This, in turn, is achieved by the feature that the primer wafer has a relatively minor thickness merely in the region of the nozzle aperture, i.e. rather than over its entire cross-sectional area, but is relatively thick in the remaining zone. Consequently, an ignition initiated, with respect to the primer wafer, in its thermally mechanically stressed region will rapidly propagate over the primer wafer, the marginal primer wafer zones, having a two- to six-fold thickness, yielding sufficient ignition energy for igniting the propellant charge.

By means of the primer wafer described herein, it is possible to reliably ignite adiabatically the cartridges even in devices having small compression volumes, i.e. in devices with relatively small piston diameters and comparatively short compression strokes.

The adiabatic ignition device according to this invention for propellant charges is thus distinguished by a nozzle and/or throttle having an extremely small cross section and by connecting the propellant charge to the nozzle by way of the specifically structured primer wafer with a thickness reduced in the region of the nozzle.

Preferably, the primer wafer extends over the entire cross-sectional area of the chamber so that there is thus present, beside the area of diminished thickness, a region still adequate as regards area and volume wherein the primer wafer has a larger thickness. The primer wafer, with a thickness of 1 to 2 mm, in the marginal zone, has in its thinned zone advantageously a thickness of $\frac{1}{3}$ to $\frac{1}{2}$ mm. The thickness of the primer wafer in the region of the nozzle and around the nozzle amounts to about 1/6 to $\frac{1}{2}$ the maximum thickness of the primer wafer. Preferably, the primer wafer is provided on one of its sides with a planar surface by means of which it is in contact with the wall provided with the nozzle and separating the chamber and the cavity, wherein the surface on the side of the primer wafer facing away from the cavity has a preferably central recess and is in contact with the propellant charge.

The reduced thickness of the primer wafer is advantageously obtained by bilateral recesses which are preferably of equal depth and in central position. With a primer wafer of such a structure, it makes no longer any difference how this primer wafer is inserted in the chamber and/or in a cartridge case.

In an advantageous further development of the invention, the provision is made that the primer wafer is devoid of a friction agent. Normally, a friction agent in the form of pulverized glass or the like is added to the primer material of the propellant charge. Upon ignition, the friction agent is released and flung away, causing erosion phenomena and contaminations in a barrel zone close to the chamber. The primer wafer of the device according to this invention, on account of its specific structure as described above, can be ignited just as well without a friction agent. As has been discovered during tests, the primer wafer exhibits a friction sensitivity which is 6 times lower, and a percussion sensitivity that is about 5 times lower, than conventional primer wafers equipped with a friction agent. This is particularly advantageous in case of use in stud driving or setting tools and the concomitant rough handling on building sites.

Preferably, the primer wafer consists of a material based on nitrocellulose to which tetrazene has been added as a sensitizer. Combustion of the primer wafer takes place with a low amount of pollutants since the primer wafer does not comprise any heavy metals. The content of tetrazene is preferably 5 to 30 wt. %; the balance of the wafer being nitrocellulose.

In an advantageous further development of the invention, the provision is made that a case member containing the propellant charge is arranged in the chamber; this case member exhibits in its bottom wall a bore in alignment with the nozzle, the primer wafer being located in the case member between the propellant charge and the bottom wall. Preferably, the primer wafer is held so that it is pressed against the bottom wall by an annular bead of the case member. The case member consists advantageously of a synthetic resin or plastic; a particularly preferred plastic is polyethylene. Accordingly, the device of this invention is suitable for the ignition of plastic cartridges by means of adiabatic compression of air and/or a gas.

Preferably, the cavity and the piston each have a cylindrical cross-sectional area, the nozzle being located in the end wall of the cylindrical cavity. The end wall of the cavity equipped with the nozzle preferably exhibits a conical recess wherein the axis of the conical recess is congruent with the central axis of the cylindrical cavity and the central axis of the nozzle. In such an end wall, the end face of the piston facing this end wall is fashioned complementarily to the conical recess, i.e. it is itself of a conical shape. In its bottom dead center position, the piston, preferably pretensioned by a spring, dips with its forward end into the recess, the conical jacket surface being in contact with the surface of the recess. On account of the above-described structure of piston and cavity, a flow oriented toward the nozzle aperture into the aperture and the chamber results during the gas compression, which has an advantageous effect on the introduction of energy into the primer wafer.

The piston is preferably equipped with a pin at its forward end, this pin dipping into the nozzle aperture in the bottom dead center position of the piston. Thereby, the gas and/or the air is compressed also in the nozzle aperture or passage which, with respect to the compression, represents a dead space.

The invention provides a device for igniting a propellant charge as a consequence of adiabatic compression of air or a gas in a cavity wherein the primer wafer igniting the propellant charge is ignited in a contactless fashion. The nozzle connecting the cavity with the chamber and acting during the explosion of the propellant charge as a throttle exhibits a diameter in the range of a few millimeters; whereas the diameter of the cavity is larger by at least a factor of 10.

Moreover, the invention concerns a cartridge, particularly for stud driving or setting tools, with a case member exhibiting a closed bottom wall, a propellant charge introduced into the case member, and a cover for the propellant charge on the side facing away from the bottom wall. The cartridge according to the invention is characterized in that a bore is formed in the bottom wall of the case member, this bore being covered by a primer wafer arranged in the case member and ignitable by heat due to gas compression; the thickness of this primer wafer in the region of the bore and around the bore is smaller than in the remaining zone of the primer wafer, the thickness of the primer wafer in the thinned region amounting to $\frac{1}{2}$ to 1/6 the thickness otherwise displayed by the primer wafer. The features of these advantageous embodiments of the invention are described in greater detail hereinafter.

The invention furthermore relates to a magazine for cartridges ignitable by heat due to gas compression, especially for stud driving or setting tools. The magazine according to the invention is characterized in that a magazine belt of a synthetic resin is provided for connecting the individual cartridges and forming bottom walls of the cartridges, wherein the magazine exhibits in the zone of the bottom walls of the cartridges at least one intentional separation zone per cartridge; that, per cartridge, one primer wafer is arranged on the magazine belt in the region of the bottom wall of the cartridge; and that the primer wafer, in the region of the intentional separation zone, is thinner than in the remaining region, the thickness in the thinned region amounting preferably to ½ to 1/6 the maximum thickness of the primer wafer. Each of these intentional separation zones is preferably fashioned as a through bore introduced into the magazine belt and covered with a thin synthetic resin film. The intentional separation zone can, however, also be designed as a (blind) bore, the depth of which is slightly smaller than the thickness of the magazine belt so that the bore is sealed by a "synthetic resin skin" integral with the magazine belt. The sealing of the cartridges by the intentional separation sites is advantageous with respect to handling and storage of the magazine. The intentional separation zone of the magazine belt will burst upon introduction of the magazine into a stud driving or setting tool wherein the associated cartridges are ignited by adiabatic compression of gas or air, so that the energy application can proceed via the cartridge bottom to the primer wafer.

Preferably, each cartridge is equipped with a cap-shaped case member held at the magazine belt, this member exhibiting a further intentional separating site. The case member houses the propellant charge which, upon ignition, allows the case member to burst at its intentional separating site so that the combustion gases are released. Preferably, the case member is integrally connected with the magazine belt. One alternative in this connection resides in that the case members are connected in a locking fashion with the magazine belt. The interlocking connection has advantages particularly from a manufacturing viewpoint since the magazine belt, after the case members have been filled with the propellant charges, can be simply placed onto the case members. The case member, as the magazine belt, advantageously consists of a synthetic resin.

Preferably, projecting collar rims lying side-by-side in continuous fashion are formed on the magazine belt and are provided on their inner surfaces with peripheral locking grooves (or peripheral protrusions) cooperating with detent lugs (locking indentations) formed on the outer surfaces of the case members. with this design of magazine belt and associated cartridges, it is advantageous to retain the primer wafers encompassed by the collar rims under pressure against the magazine belt by the end-face annular surfaces of the case members which members are in a locking connection with the collar rims. This results in a rather simple manner of fixing the primer wafers on the magazine belt and/or within the cartridges.

BRIEF DESCRIPTION OF THE DRAWINGS

Embodiments of the invention will be described in greater detail below with reference to the accompanying drawings wherein, in detail.

DETAILED DESCRIPTION OF THE INVENTION

Figure 1:
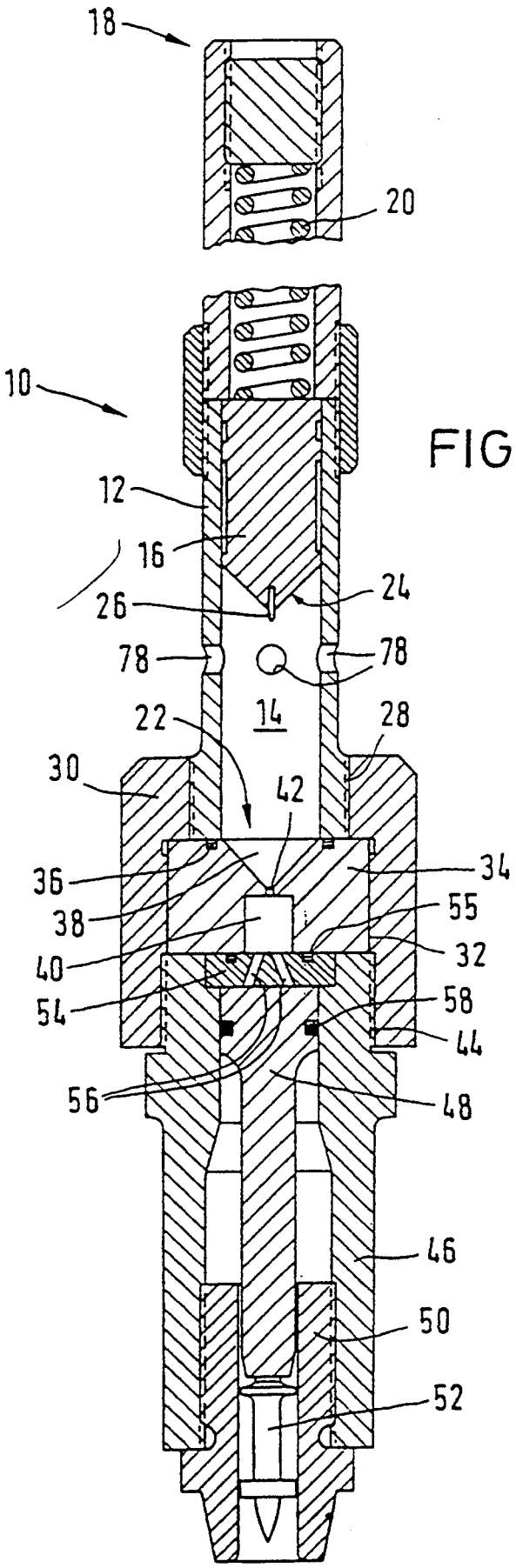
FIG. 1 shows a longitudinal section through a stud setting tool wherein a propellant charge is ignited due to adiabatic compression of air.

FIG. 1 depicts a stud setting tool 10 in a longitudinal sectional view, comprising a cylindrical housing section 12 defining a cylindrical cavity or chamber 14. The cavity 14 houses a piston 16 arranged to be slidingly displaceable and fitting in gastight fashion with the inner surface of the cylindrical housing section 12. A helical compression spring 20 is disposed between the piston 16 and the upper end 18 of the cylindrical housing section 12 on one end side. This spring advances the piston 16 in the direction toward the lower end 22 on the other end side pertaining to the cylindrical housing section 12. The forward end 24 of the piston 16 facing the lower end 22 of the cylindrical housing section 12 is of a conical shape, a thin pin 26 projecting from a conical tip.

At the lower end 22, the cylindrical housing section 12 has an external thread 28 via which the cylindrical housing section 12 is threaded into a case member 30. The case member has a through bore 32 which, in a segment equipped with an internal thread for receiving the outer thread 28, is smaller in diameter than in the remaining portion. An adaptor 34 is inserted in the bore 32 of the case member 30 and is in contact with an end-face annular surface of the lower end 22 of the cylindrical housing section 12. In this region, the adaptor 34 is provided with a sealing ring 36 for the gastight sealing of the adaptor 34 with respect to the cylindrical housing section 12. On the side of the adaptor 34 bounding the cavity 14 in the downward direction, the adaptor is equipped with a recess 38 having the shape of a conical funnel, adapted to conform to the configuration of the conical front end 24 of the piston 16. In its bottom dead center, the piston 16 dips with its front end 24 in a flush manner into the recess 38. On its side facing away from the cavity 14, a cylindrical chamber 40 arranged coaxially to the cavity 14 is worked into the adaptor 34; this chamber is in communication with the recess 38 by way a bore 42. A cartridge is accommodated in the chamber 40 as be described in more detail hereinafter with reference to FIG. 2.

The through bore 32 of the case member 30 also is provided with an internal thread in an end section facing away from the cylindrical housing section 12; an external thread 44 of a barrel 46 engages into this internal thread. A thrust piston 48 is guided in the band 46 so as to be longitudinally shiftable within the barrel 46; the end of the thrust piston facing away from the case member 30 is guided in a guide sleeve 50 threaded to the internal wall of the barrel 46. A nail or bolt 52 can be inserted in the guide sleeve 50 and is ejected from the case 50 upon a forward movement of the thrust piston 48. An insert member 54 is located at the end of the barrel 46 facing the adaptor 34 and is in contact with the adapter. This insert member, by means of a sealing ring 55, terminates tightly with the adaptor 34 and contains several exhaust ducts 56 connecting the chamber 40 with the interior space defined or encompassed by the barrel 46. The thrust piston 48 has a peripheral groove wherein a spring ring 58 of steel or the like is countersunk; this ring is in contact with the inner surface of the barrel 46 and secures the thrust piston 48 against sliding out of the barrel 46 on account of its own weight.

Figure 2:
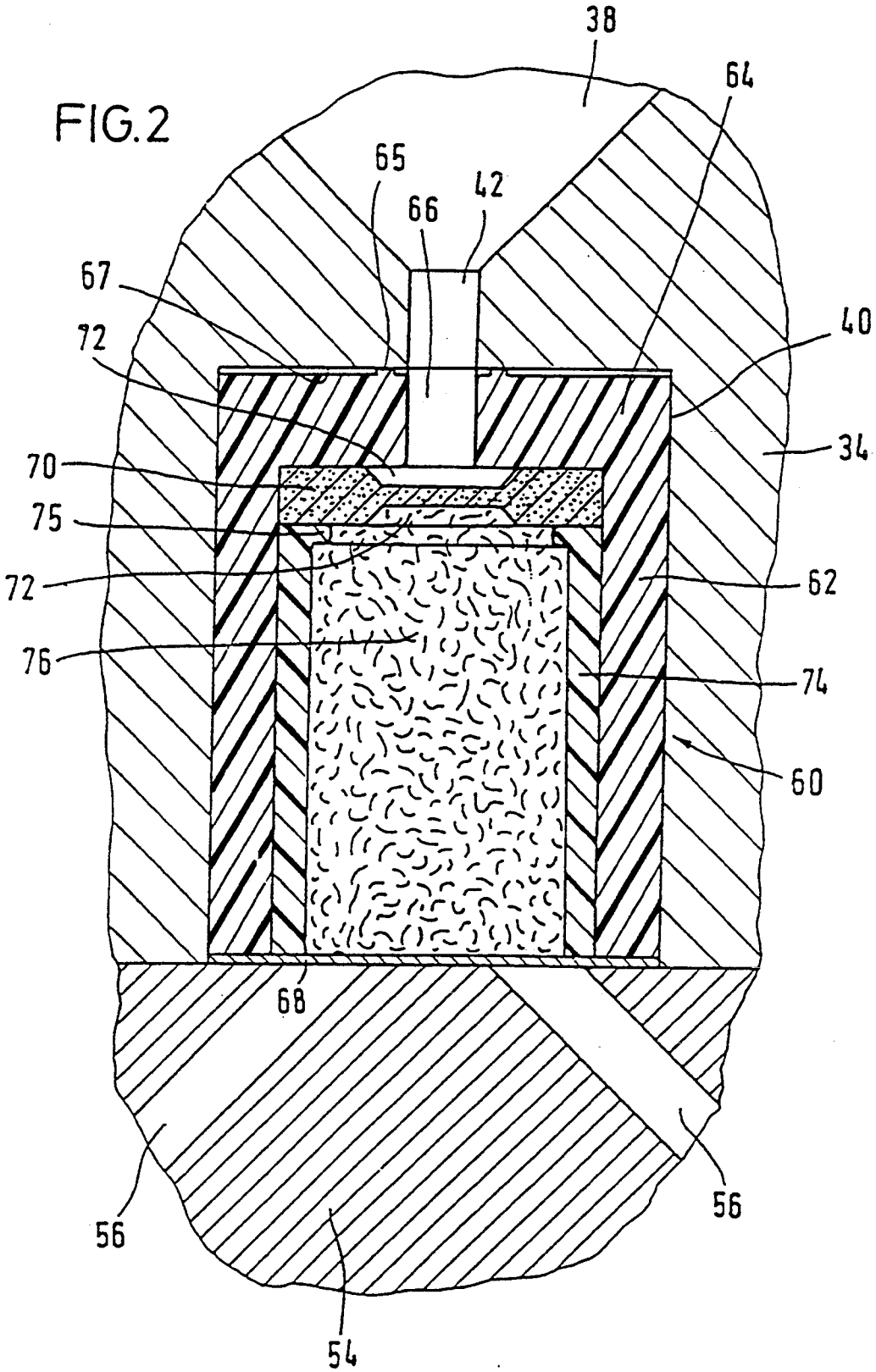
FIG. 2 is a detailed view of a central zone of the longitudinal section of the stud setting tool shown in FIG. 1, on an enlarged scale.

FIG. 2 illustrates on an enlarged scale the region of the adaptor 34 which defines the chamber 40. According to FIG. 2, a cartridge 60 is inserted in the chamber 40 of the adaptor 34, this cartridge comprising a case member 62 made of a synthetic resin. on its frontal end adjoining the bore 42, the bottom wall 64 of the case member 62 is arranged; this wall defines a central bore 66, which is in alignment with the bore 42 of the adaptor 34. Coaxially to the bore 66, the outer surface of the bottom wall 64 is provided with an integrally formed snap ring 65 in contact with the inner surface 67 of the wall separating the chamber 40 from the cavity 14 and serving as a sealing means. The other frontal end of the case member 62, facing away from the bottom wall 64 and directed toward the exhaust ducts 56, is sealed by a cover foil 68 of aluminum. A primer wafer 70, in the shape of a press-molded component, and comprised of sensitized nitrocellulose is placed from the inside against the bottom wall 64; this primer wafer contains, besides the nitrocellulose, also tetrazene and extends over the entire internal cross section of the case member 62. The primer wafer 70 covers the bore 66; in this region, the primer wafer 70 has a smaller thickness than in the peripheral or marginal zone. In the embodiment shown in FIGS. 1 and 2, the thickness of the primer wafer 70 in its marginal zone amounts to 1 to 2 mm, the primer wafer 70 has, in its central region covering the bore 66, a thickness of ½ to ⅓ mm. Whereas a portion of the surface of the primer wafer 70 facing the bottom wall 64 is planar, an indentation 72 having the shape of a truncated cone is worked into the side of the primer wafer 70 facing the aluminum cover foil A retaining sleeve 74 of plastic is in contact with the inner surface of the case member 62; this sleeve is equipped, at its upper end face, with an annular internal bead 75 in contact with the primer wafer 70 in the thickened marginal zone of the wall and retaining the primer wafer 70 in contact with the bottom wall 64. The case member 62 is filled with propellant charge powder 76.

The mode of operation of the stud setting tool 10 illustrated in FIGS. 1 and 2 is described briefly as follows: First of all, the compression spring 20 is tensioned by moving the piston 16 manually or automatically in the direction toward the upper end 18 of the cylindrical housing section 12. For example, piston 16 can be pushed upward by hand against the force of spring 20 and then locked in place by a mechanical latch, which can be released manually to trigger it. The auxiliary means required for this purpose are not included in the drawing of FIG. 1 for the sake of simplicity. Upon release of the piston 16, the piston is catapulted on account of the force of compression spring 20 toward the lower end 22 of the cylindrical housing section 12, thus adiabatically compressing the air present in the cavity 14, which air can enter the cavity via the vent opening 78. The compressed heated air (800°–1000° C.) passes via the bores 42, 66 acting as a nozzle to the primer wafer 70. In the zone where the compressed heated air acts on the primer wafer 70, the wafer has only a reduced thickness. On account of the mass of the wafer which is small in this region, the primer wafer 70 is partially heated to above its spontaneous ignition temperature. The ignition of the primer wafer 70 initiated in the mechanically and thermally stressed central zone is transmitted to the thickened marginal zone so that an ignition flame is produced, the energy of which is sufficient for igniting the propellant charge 76. While the spring force in the bottom dead center of the piston 16 acts primarily on the air flow velocity in the cavity 14 and, respectively, in the bores 42, 66 forming the nozzle, the velocity at which the piston 16 moves toward the chamber 40 acts primarily on the air temperature. On account of the connection of the cartridge 60 by way of the bore 42 of an extremely small cross section and on account of the design of the primer wafer 70 with the thinned region in the central zone, it is possible in spite of the extremely small cross sections of bores 42 and 66 with relatively minor spring energies to make sufficient energy available for the ignition of the primer wafer 70.

The circumstance that the bores 42 and 66 exhibit a small diameter has a favorable effect on the flow of the combustion gases upon ignition of the propellant charge 76. At this instant, the bores 42 and 66 act together as a throttle which makes exhausting of the combustion gases back into the cavity difficult. Since the exhaust ducts 56 in their sum total exhibit a substantially larger cross-sectional area than the bore 66 or 42, the combustion gases will be exhausted to a quite predominant part by way of the exhaust ducts 56; almost the entire combustion gas pressure is translated into a forward movement of the thrust piston 48.

In spite of the small cross section of the bores 42, 66 connecting the propellant charge 76 and, respectively, the primer wafer 70 with the (compression) cavity 14, the energy transfer in the stud setting tool 10 shown in FIGS. 1 and 2 is so satisfactory that the primer wafer 70 is ignited. This is due to the fact that the primer wafer 70 is weakened in the thermally mechanically stressed central region, i.e. in the zone of the bores 66, 42 and around these bores. The introduction of energy is so good that there is no need for the provision of friction agents as additives for the primer wafer 70.

In one specific embodiment, the diameter of nozzle 42 is 1 mm, while the diameter of cavity 14 is 15 mm. The ratio between the cross-sectional area of cavity 14 and, accordingly, the cross-sectional area of the piston 16 to the cross-sectional area of nozzle 42 should preferably be at least 25:1; a particularly preferred lower limit is 100:1; whereas, the upper limit is 400:1.

Figure 3:
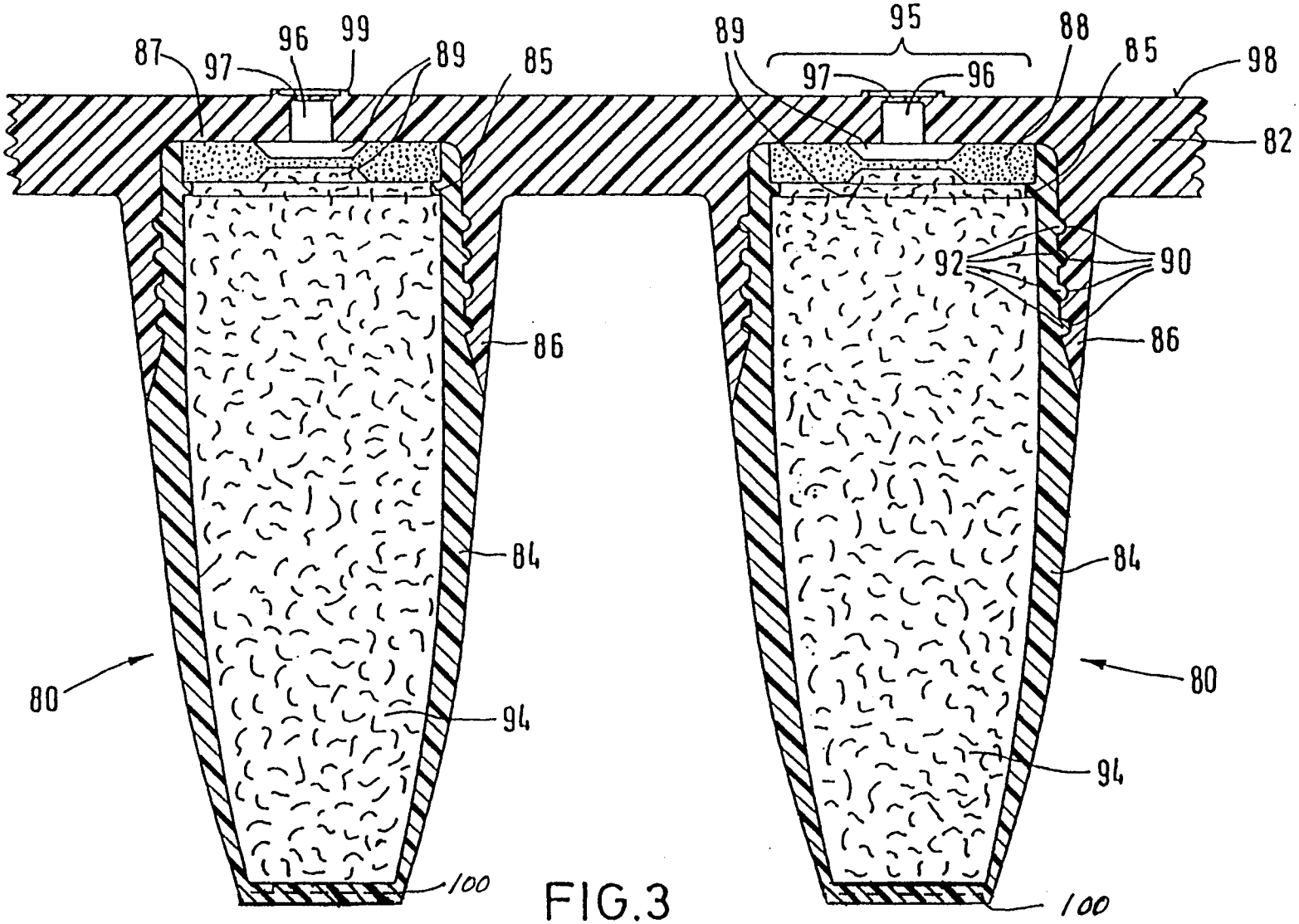
FIG. 3 shows a cross-section through a cartridge magazine with a magazine belt at which several cartridges are retained in side-by-side relationship.

With reference to FIG. 3, a magazine for holding plastic cartridges 80 will be briefly described hereinafter. This magazine can be utilized in a stud setting tool. The magazine for the cartridges 80 consists of a plastic magazine belt 82 carrying on one of its surfaces cap-like cartridge case members 84 made of a synthetic resin. The magazine belt 82 is provided on one side with continuous, projecting rims 86 connected integrally with the magazine belt 82 and projecting in the manner of a collar from one side of this belt. The collar rims 86 and the magazine belt 82 are made by injection molding from a synthetic resin in one piece. In the zones surrounded by the collar rims 86, the magazine belt 82 has an annular recess 87 wherein primer wafers 88 are inserted. The primer wafers 88 have the same configuration as the primer wafer 70 illustrated in FIG. 2. The primer wafers 88 are provided on both sides with recesses 89 of truncated cone shape.

Several locking recesses 90 are formed on the inside of each collar rim 86, engaged by corresponding peripheral locking projections 92 on the outer surface of the cap-shaped case member 84. The case member 84 snaps, via its projections 92, into the locking recesses 90. The design of locking recess and peripheral locking projection is such that it is almost impossible to pull the case member 84 out of its mounting. On its inner surface, the case member 84 is provided with an annular bead 85 or flange which bead, when the case member 84 is placed onto the magazine belt 82, is in contact with the primer wafer 88 in its thickened marginal zone and thereby retains the primer wafer in contact with the magazine belt 82 under pressure. The case member 84 can be provided, on its end-face inner surface facing the primer wafer 88, with intentional separation zones 100 which can be incorporated, for example, by injection molding or embossing. The case member 84 will burst along these intentional breaking sites upon ignition of the propellant charge 94 arranged in the case member 84.

The magazine is assembled as follows. First of all, the case members 84 are filled with the propellant charges 94. Subsequently, the primer wafers 88 are placed like lids onto the case members 84. The annular beads 85 are arranged at such a distance from the upper end of the case members 84 which is equal to the thickness of the primer wafers 88 in the marginal zone. Finally, the magazine belt 82 is placed onto the case members 84 which members are disposed side-by-side. With the case members 84 being in locking engagement with the magazine belt 82, the cuter surfaces of these members pass over in planar fashion into the outer surfaces of the associated collar rims 86; this is achieved by a corresponding beveling of the outer surfaces of the case members 84 and of the inner surfaces of the collar rims 86.

The magazine illustrated in FIG. 3 is suitable for stud driving and setting tools wherein the cartridges 80 are ignited by adiabatic compression of air. For this purpose, a connection must be established between the compression chamber and the primer wafer 88 during operation of the device. For reasons of safety and in order to avoid environmental influences, this connection, however, is to be produced only upon compression of the air. For this purpose, the provision is made in the magazine shown in FIG. 3 that a blind hole 96 is formed in the magazine belt 82 in the region of the bottom walls 95 of the cartridges 80; this blind hole has a smaller depth than the thickness of the magazine belt 82 in its bottom wall zones 95. The thus-formed synthetic resin seal 97 of the blind holes 96 bursts on account of the pressure increase during compression, thus establishing the connection between the compression chamber and the primer wafer 88 via the now open blind hole 96. On the topside 98 of the magazine belt 82, facing away from the dome-shaped case members 84, respectively one snap ring 99 is formed by molding, per blind hole 96, and is arranged coaxially to the associated blind hole; this snap ring, just as the snap ring 65 according to FIG. 2, has a sealing function and seals a throttle via which the compressed heated air passes to the cartridge 84 and, respectively, to the primer wafers 88. The thin plastic film forming the seal 97 which closes off the blind hole 96 is used for moisture protection of propellant charge 94. Preferably, the thickness of this film is 0.05 to 0.3 mm.

What is claimed is:

1. A magazine for cartridges ignitable by adiabatic compression, which comprises a magazine belt made of a synthetic resin for connecting a plurality of cartridges with one another and forming bottom walls of the cartridges; said magazine belt having, in the region of each of the bottom walls of the cartridges, an intentional separation zone; one primer wafer being provided per cartridge, each primer wafer being arranged on the magazine belt in the region of the bottom wall of the cartridge; and each primer wafer, in an area near the region of the intentional separation zone, being thinner than in a remaining zone surrounding said area.

2. A magazine according to claim 1, wherein the thickness of the primer wafer in the thinned area amounts to ½ to 1/6 of the maximum thickness of the primer wafer.

3. A magazine according to claim 1, wherein the plurality of cartridges are connected to the magazine belt and each cartridge comprises a cap-shaped case member retained at the magazine belt.

4. A magazine according to claim 3, wherein the case member exhibits least one further intentional separating zone on an end portion thereof.

5. A magazine according to claim 3, wherein the case members are integrally connected with the magazine belt.

6. A magazine according to claim 3, wherein the case members are connected with the magazine belt in a locking fashion.

7. A magazine according to claim 6, wherein the magazine belt comprises projecting collar rims arranged in side-by-side relationship in a continuous fashion, said collar rims being equipped with peripheral locking grooves on inner surfaces thereof and locking lugs formed at the case members engaging into said grooves.

8. A magazine according to claim 7, wherein the primer wafers are surrounded by the collar rims and are held in pressure contact with the magazine belt by annular surfaces on end faces of the case members in locking engagement with the collar rims.

9. A magazine according to claim 3, wherein the case members are made of a synthetic resin.

10. A magazine according to claim 1, wherein each cartridge is connected to the magazine belt and contains a propellant charge and each cartridge comprises a case member, said case member being provided with an annular bead which is in contact with the primer wafer in a thickened marginal zone, said bead acting to retain the primer wafer in contact with the magazine belt under pressure.

11. A magazine according to claim 10, wherein said magazine belt is provided on one side with continuous projecting rims connected integrally with the magazine belt, each of said cartridges comprising a case member which connects to the rims; said magazine belt having zones surrounded by the rims providing an annular recess into which a primer wafer is inserted.

12. A magazine according to claim 11, wherein the intentional separation zones in the bottom walls of the cartridges formed in the magazine belt comprise a plurality of blind holes formed therein in a region of the bottom walls of the cartridges, each blind hole having a smaller depth than the thickness of the magazine belt in the portion of the magazine belt forming the bottom wall of a cartridge and providing a cover closing off the blind hole and sealing the propellant charge within said cartridge.

13. A magazine according to claim 12, wherein said magazine belt further comprises a plurality of snap rings each formed around a blind hole and arranged coaxially to an associated blind hole, each snap ring being adapted to provide a sealing function for sealing a throttle via which a compressed heated air passes to the cartridge and respectively to a primer wafer.

14. A magazine according to claim 1, wherein the plurality of cartridges are connected to the magazine belt and wherein each intentional separation zone comprises a blind hole formed in each bottom wall of a cartridge, each blind hole having a smaller depth than the thickness of the magazine belt in the portion of the magazine belt forming the bottom wall of the cartridge and providing a cover closing off the blind hole and sealing a propellant charge within said cartridge.

15. A magazine according to claim 1, wherein said magazine belt further comprises a plurality of snap rings each formed around an intentional separation zone and arranged coaxially to an associated intentional separation zone, each snap ring being adapted to provide a sealing function for sealing a throttle via which a compressed heated air passes to an intentional separation zone and, respectively, to a primer wafer.

16. A magazine according to claim 1, wherein said plurality of cartridges are connected to the magazine belt, each of said plurality of cartridges containing a propellant charge arranged in contact with a primer wafer.

* * * * *